United States Patent [19]

Rose et al.

[11] Patent Number: 4,995,519

[45] **Date of Patent: * Feb. 26, 1991**

[54] AMPOULES

[75] Inventors: Howard Rose, 55A Popes Avenue, Strawberry Hill, Twickenham, Middlesex TW2 5TD; Ian G. C. McAffer, Westerham, both of Great Britain

[73] Assignee: Howard Rose, United Kingdom

[ * ] Notice: The portion of the term of this patent subsequent to Dec. 25, 2007 has been disclaimed.

[21] Appl. No.: 301,685

[22] Filed: Jan. 26, 1989

[30] Foreign Application Priority Data

Jan. 26, 1988 [GB] United Kingdom ..... 8801655

[51] Int. Cl.[5] ..... A61J 1/06

[52] U.S. Cl. ..... 215/32; 206/532

[58] Field of Search ..... 215/32, 33, 1 C, 31; 206/528, 530, 532, 364; 141/310; 604/403, 404, 415; 222/541

[56] References Cited

U.S. PATENT DOCUMENTS

| | | | |
|---|---|---|---|
| 3,336,924 | 8/1967 | Sarnoff et al. | 604/415 |
| 3,993,223 | 11/1976 | Welker, III et al. | 206/528 X |
| 4,566,613 | 1/1986 | Anscomb | 215/32 X |
| 4,588,090 | 5/1986 | Spuck et al. | 206/532 |
| 4,619,651 | 10/1986 | Kopfer et al. | 604/415 |
| 4,643,309 | 2/1987 | Evers | 215/32 X |

FOREIGN PATENT DOCUMENTS

| | | | |
|---|---|---|---|
| 88056 | 9/1983 | European Pat. Off. . | |
| 805846 | 5/1951 | Fed. Rep. of Germany | 141/310 |
| 2454191 | 5/1976 | Fed. Rep. of Germany | 215/32 |
| 2439312 | 6/1976 | Fed. Rep. of Germany . | |
| 3507799 | 9/1985 | Fed. Rep. of Germany | 215/1 C |
| 3439420 | 4/1986 | Fed. Rep. of Germany | 604/403 |
| 548205 | 4/1974 | Switzerland . | |
| 1161745 | 8/1969 | United Kingdom | 215/32 |
| 2039267 | 8/1980 | United Kingdom | 215/32 |

OTHER PUBLICATIONS

Annex to the European Search Report, 12/22/89.

*Primary Examiner*—Sue A. Weaver

*Attorney, Agent, or Firm*—Waldron & Associates

[57] ABSTRACT

The present invention provides plastics ampoules made by the blow-fill-seal method which substantially overcome the problem of touch contamination of the neck of the ampoule by providing a funnel leading to the neck, this funnel also assisting docking of the head of a syringe.

12 Claims, 1 Drawing Sheet

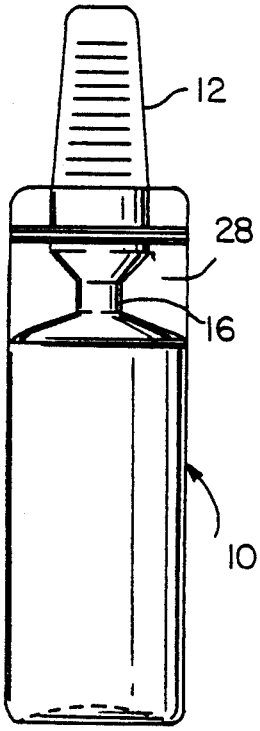
FIG. 1
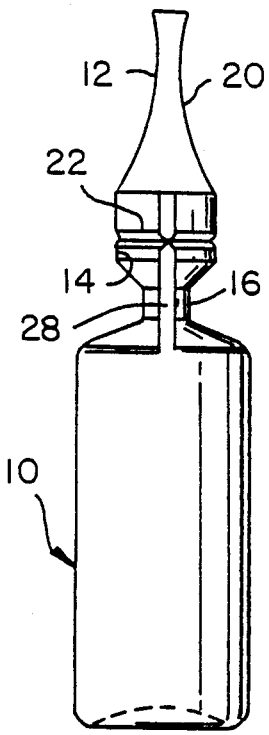
FIG. 2
FIG. 3
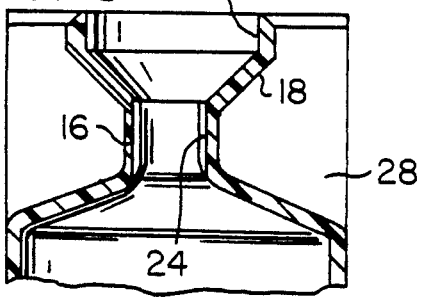
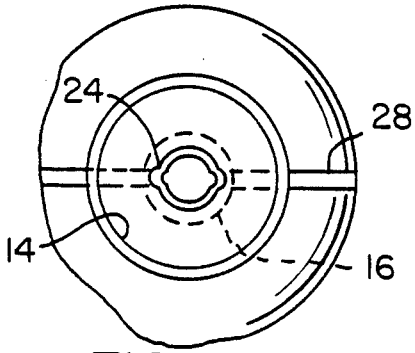
FIG. 4
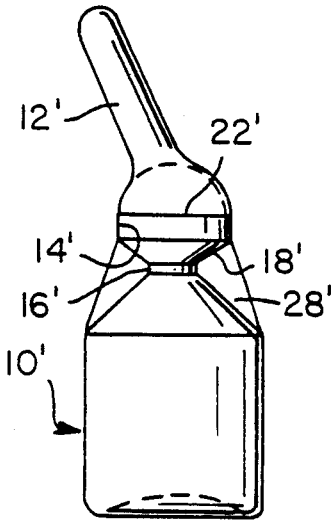
FIG. 5
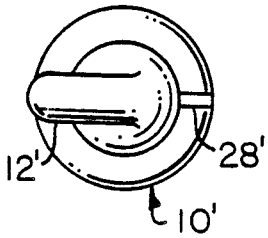
FIG. 7
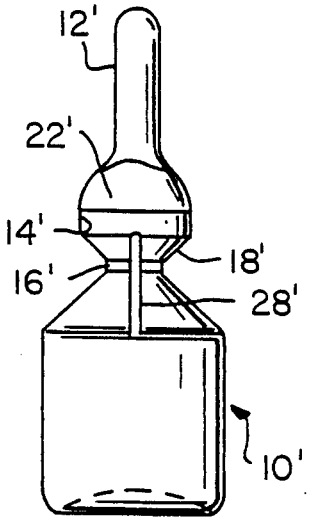
FIG. 6
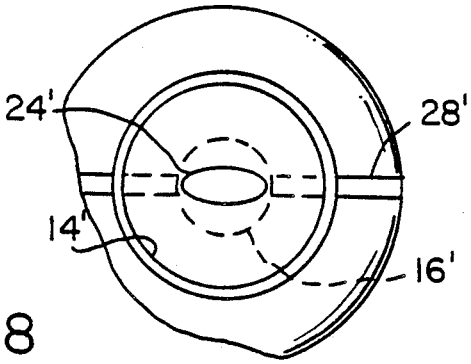
FIG. 8

AMPOULES

FIELD OF THE INVENTION

The present invention relates to plastics ampoules, having snap-off heads, for pharmaceutical use, and especially to ampoules for liquids for injection into a patient.

PRIOR ART

Ampoules are traditionally made of glass, and are widely adopted for sterile storage of liquids intended for pharmaceutical use. For example, glass ampoules can be used for pharmaceutically active solutions for direct injection, as well as for water, saline solution or other liquids which are employed for preparing injections by reconstitution or dilution.

The use of glass ampoules gives rise to several disadvantages. A glass ampoule is opened by breaking off the head, leaving an exposed neck with a dangerous cutting edge. There is a high risk that the user, such as a nurse, might cut themselves on the exposed edge, generating a risk of cross-infection. Fragments of glass are also generated and increase this risk. In addition microfragments of glass may intermingle with the liquid in the ampoule, and can thereafter be injected into the patient.

In the typical procedure for preparing an injection, a first disposable needle with sheath is fitted on the luer head of a syringe, the sheath is temporarily removed, and the liquid in the ampoule is drawn up into the syringe to a required volume. The needle is normally resheathed and discarded, to be replaced by a second fresh needle of smaller diameter for the actual act of injection. This procedure inevitably includes the risk that the user will stick the needle into himself, further increasing the possibilities for cross-infection.

After use, the ampoule, syringe and needles are thrown away. Such dangerous objects, collectively included within the term "sharps", are supposed to be safely discarded in accordance with set procedures. However, such procedures are not invariably followed. There are several reports in the literature of infection of hospital staff with AIDS through infection by sharps present in waste material.

In general, there is a desire to replace glass ampoules with safer materials.

Ampoules made of plastics material such as polyethylene, polypropylene and polyvinyl chloride are known, and are usually moulded, filled and sealed using machines manufactured and sold, for example, by Kocher Plastik and Rommelag AG, as well as Weiler Engineering Inc. Such plastics ampoules are typically made by the blow-fill-seal method, a technique which blow-moulds the ampoule, and then fills and seals it in one continuous operation. This technique minimize the risk of contamination of the ampoule prior to use.

Numerous designs of plastics ampoule have been devised, including the use of a twist-off head and a female luer neck. Such ampoules are disclosed in EP-A-0 088 156, the ampoules having a standardised (luer) female cone intended for air-tight connection with the male head of a syringe, a twist-off cap sealing the ampoule prior to use. Such a design reduces the risk of needle stick injuries as the male luer head of the syringe is directly mated to the ampoule for filling, without the need for a first disposable needle.

Nevertheless, all existing designs of ampoule, be they glass or plastic, are still subject to 'touch contamination', that is, contamination of the ampoule by physical contact during, or after, the act of breaking the seal. Indeed, with some designs, such contamination is inevitable.

OBJECTS OF THE INVENTION

It is an object of the present invention to provide an ampoule having a reduced risk of touch contamination.

It is a further object of the present invention to provide an ampoule which facilitates docking of the syringe head with the neck of the ampoule.

It is a yet further object of the present invention to provide an ampoule which reduces the risk of touch contamination of the head of a syringe.

DESCRIPTION OF THE INVENTION

In accordance with the present invention, the problem of touch contamination is substantially overcome by the incorporation of a wide neck, leading to the female recess, in the design of the ampoule.

DETAILED DESCRIPTION OF THE INVENTION

Thus, the present invention provides a plastics ampoule having an opening comprising a dispensing neck, a removable head being located over the opening, characterised in that the opening further comprises a funnel leading to the neck.

Inadvertent physical contact with the funnel is, therefore, of little importance as the male head of the syringe docks with the neck of the ampoule. Furthermore, the provision of a funnel, or docking target further facilitates the operation of syringe loading, avoiding fiddly connection of syringe and ampoule, which can lead to contamination, and saving time, which can be of the essence if many injections are necessary.

The funnel essentially serves to lead the male head of the syringe to engagement with the dispensing neck of the ampoule, optionally a female luer. In its capacity as contamination preventative, the shape of the funnel is of little consequence, provided that the male head of the syringe is obliged to pass through the funnel before engaging the neck. However, for practical purposes, the contours of the funnel will normally be rounded to avoid catching and for ease of moulding. Also, in order to assist the engagement of syringe with neck, it is generally preferable that the funnel has a gradual transition from the wider opening to the narrower neck, rather than having an essentially tubular shape with the neck located in the base wall.

The aperture, or target area, of the funnel suitably has an internal cross-sectional area which is at least 3 or 4 times the minimum internal cross-sectional area of the neck.

The target area is preferably of circular or generally curved (including oval) shape. For a circular target area, the quoted area ratio of 3:1 gives a diameter ratio of $\sqrt{3}$:1. The diameter ratio is more usually >2:1, preferably >2.5:1. Considering a minimum neck diameter of 4 mm, the diameter of the target aperture will preferably be from 8 to 16 mm, such as around 12 mm. With a neck diameter of 7 mm, the target area diameter is advantageously around 15 mm.

The removable head of the ampoule is preferably a twist-off, or snap-off, head which can be gripped by a user. The portion to be gripped is preferably thin, in the form of a tab or other thin grip. The twist-off head suitably has a moulded surface to facilitate gripping, and preferably extends from a frangible break-line around the target area of the aperture.

In one particularly preferred construction, a twist-off head extends from the break-line to a thin grip, transforming from a circular cross-section to a generally rectangular cross-section through a tapering portion.

In another preferred embodiment, there is provided a snap-off head, the head extending from a thin break-line to an angled, rod-like grip, tapering from a wide circular cross-section to a narrower circular cross-section, solid or hollow, at an angle from the vertical. Pulling the rod-like grip towards the vertical exerts stress on the break-line under the grip, breaking off the head.

Both of the above embodiments serve to further prevent touch contamination, as the region acted upon by the user to break the seal is remote from the break-line.

In general, it is preferred that the removable head is designed so as to enhance the sterility in use. The presence of the head over the target aperture maintains sterility of the internal surface of the aperture, transition zone and neck, until its removal. The head is preferably designed so that the user does not tend to finger the aperture. In the above embodiments, a flared twist-off head acts as a shield or guard, and the tapering portion minimizes the risk of introducing infection.

The neck of the ampoule may be of any shape suitable for mating with the head of a syringe. A luer neck forms one preferred embodiment, a large proportion of syringes having luer heads. However, in accordance with a preferred feature of the present invention, there is provided a neck wherein adjacent walls are parallel. Ampoules with such necks are easier to manufacture, allow easier mating with the syringe head, and are no less efficient than standardized necks. Other types of neck are also of use, and types of cone will be apparent to those skilled in the art.

The ampoules of this invention are typically manufactured by the blow-fill-seal method, although any suitable method may be employed. Thermoformable plastics are preferred, especially polyethylene and polypropylene.

The frangible membrane, or break-line, connecting the head to the opening may be formed by any means suitable. If the ampoule is formed by the blow-fill-seal method, the break-line is typically formed by the use of a cutter located about the 'blow nozzle'. A cutter external to the ampoule could also be used but tends to be less satisfactory. Other methods of weakening the break-line tend to be more expensive and no better, such as localised radiation.

The neck preferably has one or more grooves or other form of channel which prevent a build-up of vacuum within the ampoule as liquid is drawn up into the syringe. For preference, the neck has two diametrically opposed channels. In one embodiment, the neck is oval in shape, the wider diameter effectively providing the grooves.

The dimensions of the ampoules are selected according to requirements. Typical volumes are 10–20 ml but volumes ranging considerably beyond these are feasible. The overall proportions shown in the accompanying drawings form preferred embodiments, the measurements being substantially as shown.

DRAWINGS

The present invention is further illustrated by the following non-limiting examples, which refer to the accompanying drawings. In the drawings:

FIGS. 1 and 2 show vertical elevations of an ampoule manufactured in accordance with this invention;

FIG. 3 shows an enlarged vertical cross-section of part of the ampoule of FIGS. 1 and 2 with the head removed;

FIG. 4 shows an enlarged view from above of part of the ampoule portion shown in FIG. 3, with the head removed to illustrate the opening to the internal cavity.

FIGS. 5 and 6 show vertical elevations of an alternative ampoule of the invention; and FIG. 7 shows a view from above of the ampoule of FIGS. 5 and 6.

FIG. 8 is substantially like FIG. 4 except that it illustrates an alternative embodiment for the neck portion of the opening.

The plastics ampoule 10 of FIGS. 1 to 4 has a removable head 12 which removes to reveal a relatively wide aperture 14 leading to a female luer 16 via a transition 18. The relatively wide aperture acts as a docking target for capturing the male luer of a syringe, and funnelling the syringe male luer towards engagement with the ampoule female luer.

The aperture 14 at the opened end of the ampoule is of circular cross-section, with an internal diameter of about 12 mm, while the luer has a minimum internal diameter of about 4 mm.

The removable head 12 of the ampoule is a twist-off head which can be gripped by a user. The portion 20 to be gripped is relatively thin, and has a moulded surface to facilitate gripping. It extends from a frangible break line 22 around the target area of the aperture, and transforms through a tapering section to a generally rectangular, narrow cross-section.

The female luer 16 has two diametrically opposed grooves 24.

In use, the head 12 can readily be snapped off from the ampoule to reveal the relatively large aperture for receiving the syringe and funnelling it into luer-to-luer engagement. The circular lead face of the head 12 acts as a shield to prevent contact with the aperture of the fingers gripping the thin part of the head. The two grooves 24 in the female luer serve to prevent a build up of vacuum within the ampoule as liquid is drawn up the syringe.

The ampoule of FIGS. 4–8 corresponds to that of FIGS. 1–3 in essential detail. However, the neck 26 has parallel walls and is oval in cross-section. In this example, the diameters are 5 and 7 mm, the larger effectively providing the equivalent of grooves 24 in FIGS. 1–3.

In both embodiments of the Figures, walls 28 and 28' provide support means to strengthen the ampoule when the head is removed. Any other suitable strengthening means, if any is required, may be used, for example, reinforced walls (ribbing or thickened walls).

It will be appreciated that the foregoing is not an exhaustive description of the invention, which should be interpreted in accordance with the appended claims.

What is claimed is:

1. A plastic ampoule having an internal cavity, an opening to said internal cavity and a removable head sealing said opening, said opening comprising a dispensing neck extending from said internal cavity towards a mouth of said opening and adapted to receive a syringe head; the improvement comprising:

said opening further comprising a funnel between said dispensing neck and said mouth, said funnel having an aperture with an internal diameter which is at least $\sqrt{3}$ times the minimum diameter of said dispensing neck to facilitate engagement of said syringe head with said dispensing neck by providing a protected docking target for said syringe head.

2. The ampoule of claim 1, wherein said removable head is sealed over the mouth of said funnel by a frangible membrane.

3. The ampoule of claim 1, made by the blow-fill-seal method.

4. The ampoule of claim 1, further comprising means for rigidifying said funnel.

5. The ampoule of claim 4 wherein said rigidifying means comprises at least one wall extending upwards from the body of said ampoule to support said funnel.

6. The ampoule of claim 1 wherein said neck is adapted to receive the male luer head of a syringe.

7. The ampoule of claim 1 wherein said neck is a female luer.

8. The ampoule of claim 1 wherein adjacent walls of said neck are substantially parallel.

9. The ampoule of claim 1 wherein said neck comprises at least one groove extending the length of said neck.

10. The ampoule of claim 1 wherein said neck is of substantially oval internal cross-section.

11. The ampoule of claim 1 in which the internal diameter of said funnel is at least 2 times the minimum diameter of said dispensing neck.

12. The ampoule of claim 1 in which said funnel aperture has an area of at least 3 times the minimum internal area of said dispensing neck.

* * * * *

UNITED STATES PATENT AND TRADEMARK OFFICE

CERTIFICATE OF CORRECTION

PATENT NO. : 4,995,519

DATED : February 26, 1991

INVENTOR(S) : Howard Rose and Ian G.C. McAffer

It is certified that error appears in the above-identified patent and that said Letters Patent is hereby corrected as shown below:

On the title page, item [73], please correct the name of the Assignee to read --Waverley Pharmaceutical Limited--.

Signed and Sealed this

Eleventh Day of August, 1992

*Attest:*

DOUGLAS B. COMER

*Attesting Officer*

*Acting Commissioner of Patents and Trademarks*